US007355329B2

(12) United States Patent
Wei et al.

(10) Patent No.: US 7,355,329 B2
(45) Date of Patent: Apr. 8, 2008

(54) FIELD EMISSION LAMP

(75) Inventors: Yang Wei, Beijing (CN); Peng Liu, Beijing (CN); Lei-Mei Sheng, Beijing (CN); Liang Liu, Beijing (CN); Zhao-Fu Hu, Beijing (CN); Cai-Lin Guo, Beijing (CN); Pi-Jin Chen, Beijing (CN); Shou-Shan Fan, Beijing (CN)

(73) Assignees: Tsinghua University, Haidian District, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 137 days.

(21) Appl. No.: 11/184,454

(22) Filed: Jul. 19, 2005

(65) Prior Publication Data

US 2006/0022576 A1 Feb. 2, 2006

(30) Foreign Application Priority Data

Jul. 29, 2004 (CN) ..... 2004 1 0050966

(51) Int. Cl.
*H01J 1/02* (2006.01)
*H01J 19/00* (2006.01)

(52) U.S. Cl. ..... 313/309; 313/311; 313/336; 313/351; 313/496

(58) Field of Classification Search ..... 313/495–497, 313/309, 311, 336, 351, 634, 635, 573
See application file for complete search history.

(56) References Cited

U.S. PATENT DOCUMENTS 4,818,914 A * 4/1989 Brodie ..... 315/169.3
5,210,462 A * 5/1993 Konishi ..... 313/495
2002/0070648 A1* 6/2002 Forsberg ..... 313/309

FOREIGN PATENT DOCUMENTS

CN 2556783 Y 6/2003

* cited by examiner

*Primary Examiner*—Ashok Patel
(74) *Attorney, Agent, or Firm*—Morris Manning Martin LLP

(57) ABSTRACT

A field emission lamp includes: a transparent bulb (10) having a neck portion; a lamp head mated with the neck portion; an anode layer (20) formed on an inner surface of the bulb; a fluorescence layer (30) formed on the anode layer; a cathode electrode (43) and an anode electrode (23) located at the lamp head; an anode down-lead ring (24) located at the neck portion, the anode down-lead ring engaging with the anode layer and electrically connecting with the anode electrode via an anode down-lead pole (21) and a pair of down-leads (22); and an electron emitting cathode positioned in the bulb and engaging with the cathode electrode. The field emission lamp is safe for humans and environmentally friendly, provides a high electrical energy utilization ratio, and has a reduced cost.

20 Claims, 2 Drawing Sheets

FIELD EMISSION LAMP

BACKGROUND OF THE INVENTION

1. Field of the Invention

The invention relates generally to lamps, and more particularly to the field emission lamps.

2. Description of Related Art

Electrical lamps are virtual necessities in modem daily living, and conventional electrical lamps generally include incandescent lamps and fluorescent lamps. A typical incandescent lamp is simple to manufacture. However, most electric energy consumed by the incandescent lamp is converted into heat energy and cannot be used for luminescence. In other words, the incandescent lamp has a low electrical energy utilization ratio, and is uneconomical.

A conventional fluorescent lamp has a higher electric energy utilization ratio compared to the incandescent lamp. A typical conventional fluorescent lamp generally includes a transparent glass tube, white or colored fluorescent material coated on an inner surface of the transparent glass tube, and mercury vapor filled in the transparent glass tube. In use, electrons are accelerated by an electric field so that the accelerated electrons collide with the mercury vapor. This causes excitation of the mercury vapor and subsequent remission. The remission process causes radiation of ultraviolet rays. The ultraviolet rays irradiate the fluorescent material, whereby the ultraviolet rays are converted into visible light.

The mercury vapor is toxic to humans and is environmentally unsafe. Thus, fluorescent lamps not adopting mercury vapor have been sought. FIG. 4 represents a conventional fluorescent lamp not using mercury vapor, as disclosed in China Patent No. 02234995.2. The fluorescent lamp includes a glass tube 1, fluorescent material 3 formed on an inner surface of the glass tube 1, a conductive film 2 formed on an outer surface of the glass tube 1, a pair of outer electrodes 5 located at opposite ends of the glass tube 1, and inert gases such as xenon vapor 4 filled in the glass tube 1. In use, high frequency alternating voltage is applied to the outer electrodes 5, thereby causing electrons to be accelerated therefrom. The accelerated electrons then collide with the xenon vapor 4. This causes excitation of the xenon vapor 4 and subsequent remission. The remission process causes radiation of ultraviolet rays. The ultraviolet rays irradiate the fluorescent material 3, whereby the ultraviolet rays are converted into visible light.

The above-described fluorescent lamp adopts inert gases such as xenon vapor instead of mercury vapor, and is thus safe for humans and environmentally friendly. However, adopting inert gases increases the cost of the fluorescent lamp. Furthermore, the inert gases are apt to leak out, and this results in the fluorescent lamp becoming dim or even failing to luminesce at all. Moreover, the fluorescent lamp generally adopts a hot cathode, and therefore needs a high working voltage. As a result, the electric energy utilization ratio of the fluorescent lamp may still be considered to be unsatisfactory.

What is needed, therefore, is a fluorescent lamp having a high electrical energy utilization ratio, low energy consumption, and a low cost.

SUMMARY

In a preferred embodiment, a field emission lamp generally includes a transparent bulb, a lamp head, an anode layer, a fluorescence layer, a cathode electrode, an anode electrode, an anode down-lead ring and an electrical emitting cathode. The transparent bulb has a neck portion, while the lamp head is mated with the neck portion. The anode layer is formed on an inner surface of the bulb, and the fluorescence layer is formed on the anode layer. Further, the cathode electrode and the anode electrode are located at the lamp head. The anode down-lead ring is located at the neck portion, engages with the anode layer, and electrically connects with the anode electrode via an anode down-lead pole and a pair of down-leads. The electron emitting cathode is positioned in the bulb and engages with the cathode electrode. The bulb is vacuumized, and the field emission lamp further includes a getter used to absorb residual gas in the bulb.

Compared with a conventional field emission lamp, the field emission lamp of any of the described embodiments has the following advantages. Firstly, the field emission lamp does not adopt mercury vapor or other noxious vapor, and thus is safe for humans and environmentally friendly. Secondly, the bulb of the field emission lamp is vacuumized. There is no need for a filling gas, and costs are reduced. Thirdly, the field emission lamp adopts a cold cathode, thereby providing a high electrical energy utilization ratio and low energy consumption.

Other advantages and novel features will become more apparent from the following detailed description of preferred embodiments when taken in conjunction with the accompanying drawings.

BRIEF DESCRIPTION OF THE DRAWINGS

The above-mentioned and other features and advantages of the invention, and the manner of attaining them, will become more apparent and the invention will be better understood by reference to the following description of embodiments of the invention taken in conjunction with the accompanying drawings, wherein.

Figure 1:
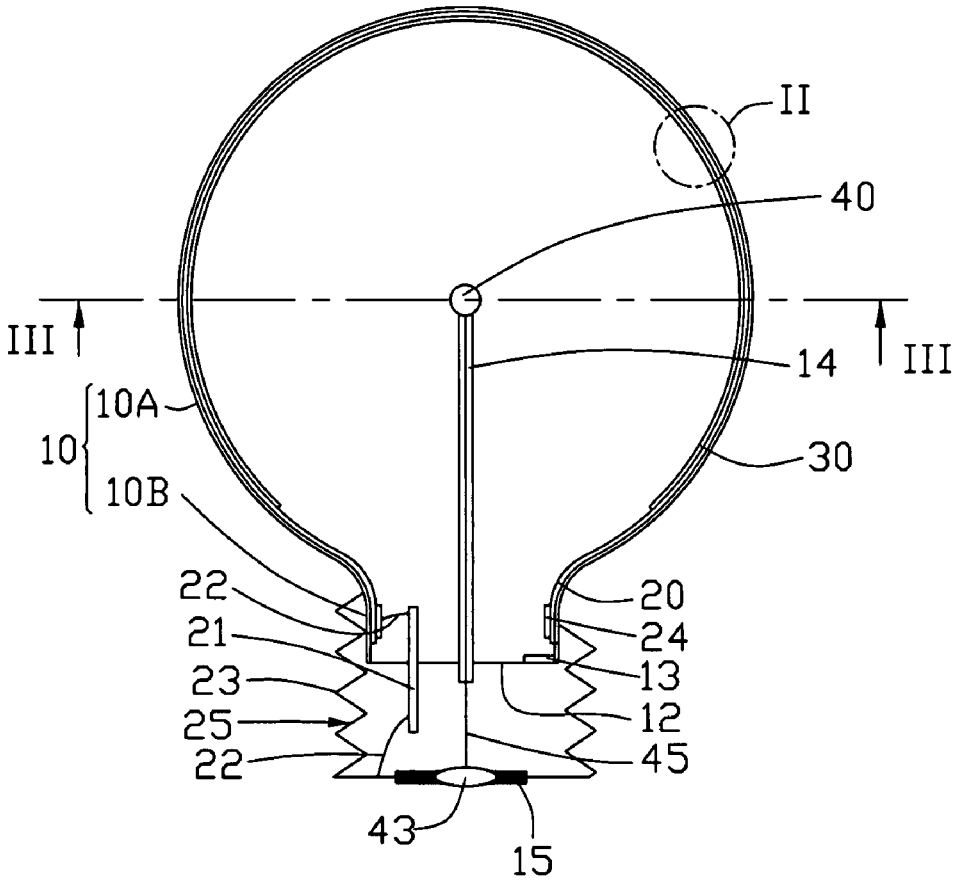
FIG. 1 is a schematic, cross-sectional view of a field emission lamp in accordance with a preferred embodiment of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF PREFERRED EMBODIMENTS

Reference will now be made to the drawings to describe preferred embodiments of the present invention in detail.

Figure 2:
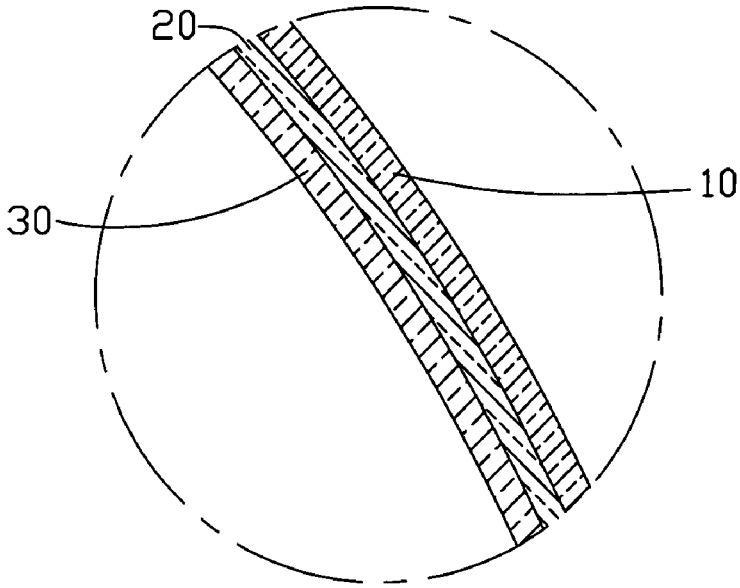
FIG. 2 is an enlarged view of a circled portion II of FIG. 1.

Referring to FIGS. 1 and 2, a field emission lamp includes: a lamp body of the lamp, for example, a transparent glass bulb 10 having a main portion 10A and a neck portion 10B; a lamp head 25 mated with the neck portion 10B; an anode layer 20 formed on an inner surface (not labeled) of the bulb 10; a fluorescence layer 30 formed on the anode layer 20; a cathode electrode 43 and an anode electrode 23 located at the lamp head; an anode down-lead ring 24 located at the neck portion 10B, the anode down-lead ring 24 engaging with the anode layer 20 and electrically connecting with the anode electrode 23 via an anode down-lead pole 21 and a pair of anode down-leads 22; and an electron emitting cathode positioned in the bulb 10 and engaging with the cathode electrode 43.

The anode layer 20 is a transparent conductive film, such as an Indium Tin Oxide (ITO) film. The fluorescence layer 30 can be white or colored. The anode layer 20 covers an inner surface of the main portion 10A of the bulb 10 and an inner surface of the neck portion 10B of the bulb 10, and the fluorescence layer 30 covers the anode layer 20 at the inner surface of the main portion 10A of the bulb 10. The neck portion 10B is sealed by an endpiece 12.

The anode electrode 23 is screw-thread shaped, and is located at side surfaces (not labeled) and a bottom surface (not labeled) of the lamp head 25. The anode down-lead pole 21 is located at the endpiece 12. One of the anode down-leads 22 is fixed between the anode electrode 23 and the anode down-lead pole 21, and the other anode down-lead 22 is fixed between the anode down-lead pole 21 and the anode down-lead ring 24. Thereby, the anode electrode 23 is electrically connected with the anode layer 20. The cathode electrode 43 is located at and protrudes from the bottom surface of the lamp head 25. Furthermore, an electrically and thermally insulative medium 15 is formed between the anode electrode 23 and the cathode electrode 43, to insulate the anode electrode 23 from the cathode electrode 43. A getter 13 as typically known in the art is formed on the endpiece 12 by means of high frequency evaporation. For example, the getter 13 may comprise a conductive film. The getter 13 is used to absorb residual gas in the field emission lamp.

The electron emitting cathode is used to emit electrons, and includes a metallic base body 40, an insulative glass column 14, and a cathode down-lead 45. The metallic base body 40 is located at a center of the bulb 10. The metallic base body 40 may be a sphere or a polyhedron. In the illustrated embodiment, the metallic polyhedron 40 is a metallic sphere 40. The insulative glass column 14 supports the metallic sphere 40. The cathode down-lead 45 is embedded in the insulative column 14, and opposite ends of the cathode down-lead 45 are electrically connected with the metallic sphere 40 and the cathode electrode 43 respectively. The cathode down-lead 45 is made of a metallic wire, and electrically connects the cathode electrode 43 with the metallic sphere 40. A diameter of the metallic sphere 40 is much smaller than that of the bulb 10, and is in the range from 1 millimeter to several millimeters or more. A length of the insulative glass column 14 is about the same as or a little greater than a radius of the bulb 10. Thus the glass column 14 can position the metallic sphere 40 at the center of the bulb 10, and this ensures that all areas of the fluorescence layer 30 are equally impinged by electrons.

Figure 3:
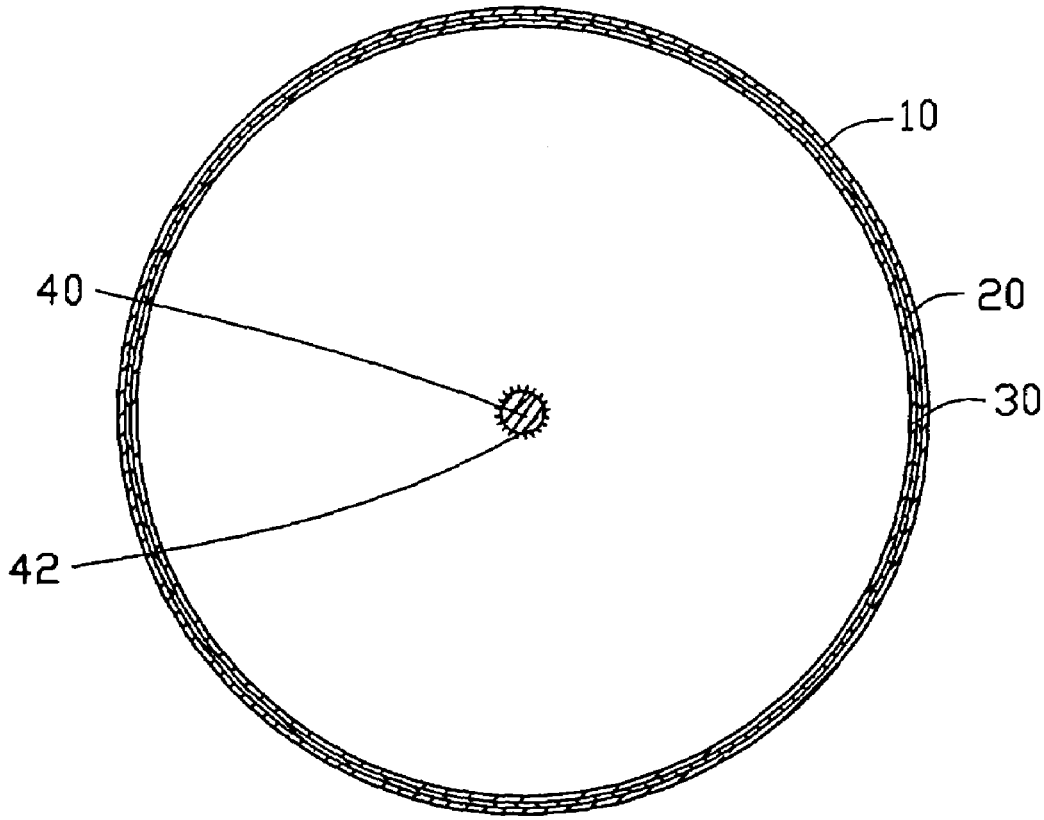
FIG. 3 is an enlarged, schematic cross-sectional view taken along line III-III of FIG. 1.
Figure 4:
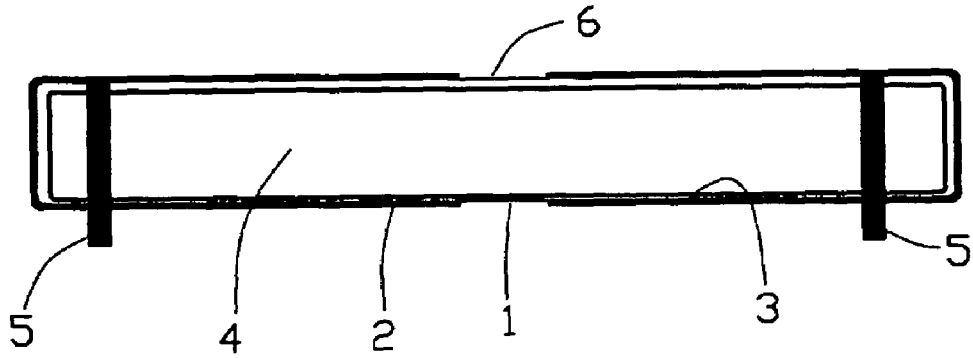
FIG. 4 (PRIOR ART)
FIG. 4 is a schematic, abbreviated, cross-sectional view of a conventional field emission lamp.

Referring to FIG. 3, the metallic sphere 40 has a plurality of electron emittersformed on an outer surface thereof. The electron emitters may be carbon nanotubes 42. The carbon nanotubes 42 are formed by means of chemical vapor deposition (CVD) or electrophoretic deposition. Preferably, each carbon nanotube 42 has at least one end exposed to the outer surface of the metallic sphere 40. More preferably, each carbon nanotube 42 is perpendicular to the outer surface of the metallic sphere 40. While the carbon nanotubes 42 may be the preferred form for the electron emitters, it is understood that the electron emitters could have other shapes (e.g., conical) and/or be made of other emissive materials as known in the field emission art, and still be within the scope of the present invention. Further, in the case where the metallic base body 40 is a polyhedron, it is envisaged that the polyhedron would be generally sphere-like. For example, the polyhedron may have between 10 and 20 sides. With such configuration, the metallic base body 40 can ensure that all areas of the fluorescence layer 30 are substantially equally impinged by electrons. In addition, the electron emitters such as the carbon nanotubes 42 can be readily formed on the flat faces of the polyhedron.

In use, the anode electrode 23 is grounded, and an appropriate negative voltage is applied to the cathode electrode 43, thereby forming a strong field between the metallic sphere 40 and the anode layer 20. The strong field excites the carbon nanotubes 42 on the outer surface of the metallic sphere 40 to emit electrons, and the electrons bombard the fluorescence layer 30, thereby producing visible light.

Compared with a conventional field emission lamp, the field emission lamp of any of the described embodiments has the following advantages. Firstly, the field emission lamp does not adopt mercury vapor or other noxious vapor, and thus is safe for humans and environmentally friendly. Secondly, the bulb of the field emission lamp is vacuumized. There is no need for a filling gas, and costs are reduced. Thirdly, the field emission lamp adopts a cold cathode, thereby providing a high electrical energy utilization ratio and low energy consumption.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

We claim:

1. A field emission lamp comprising:

a bulb being vacuum sealed and having an inner surface;

a lamp head mated with the bulb;

an electron emitting cathode positioned in the bulb, wherein the electron emitting cathode comprises a plurality of electron emitters, and a base body having an outer surface, the base body is comprised of metallic material, and the electron emitters are carbon nanotubes and are formed on the outer surface of the base body;

an anode layer formed on the inner surface of the bulb;

a fluorescence layer formed on the anode layer;

an anode electrode located at the lamp head and electrically connected with the anode layer; and a cathode electrode located at the lamp head and electrically connected with the electron emitting cathode.

2. The field emission lamp as claimed in claim 1, wherein the bulb has a bulb center, and the base body is located at the bulb center.

3. The field emission lamp as claimed in claim 2, wherein the base body is a metallic sphere, and has a diameter in the approximate range of 1 millimeter to nine millimeters.

4. The field emission lamp as claimed in claim 2, wherein the base body is polyhedral.

5. The field emission lamp as claimed in claim 2, wherein the carbon nanotubes are formed on the outer surface of the base body via chemical vapor deposition (CVD) or electrophoretic deposition.

6. The field emission lamp as claimed in claim 5, wherein each carbon nanotube has at least one end exposed to the outer surface.

7. The field emission lamp as claimed in claim 6, wherein each carbon nanotube is perpendicular to the outer surface.

8. The field emission lamp as claimed in claim 7, wherein the electron emitting cathode further comprises an insulative glass column supporting the base body.

9. The field emission lamp as claimed in claim 8, wherein the electron emitting cathode further comprises a cathode down-lead embedded in the insulative column, the cathode down-lead having opposite down-lead ends, the down-lead ends being electrically connected with the base body and the cathode electrode, respectively.

10. The field emission lamp as claimed in claim 1, wherein the bulb is made of glass, the bulb being sealed by an endpiece, the bulb being comprised of a bulb main portion and a bulb neck portion.

11. The field emission lamp as claimed in claim 10, wherein the lamp head is fixed on the bulb neck portion.

12. The field emission lamp as claimed in claim 1, wherein an electrically and thermally insulative medium is located at the lamp head between the anode electrode and the cathode electrode.

13. The field emission lamp as claimed in claim 1, wherein the anode layer comprises an Indium Tin Oxide (ITO) film.

14. The field emission lamp as claimed in claim 1, wherein the fluorescence layer is white or colored.

15. The field emission lamp as claimed in claim 1, further comprising an anode down-lead ring, and wherein the bulb comprises a bulb neck portion, the anode down-lead ring being located at the bulb neck portion, and the anode down-lead ring engaging with the anode layer and being electrically connected with the anode electrode.

16. The field emission lamp as claimed in claim 1, further comprising an anode down-lead pole, a pair of anode down-leads and an endpiece associated with the bulb, the anode down-leads being located at the endpiece, one of the anode down-leads being fixed between the anode electrode and the anode down-lead pole, and the other anode down-lead being fixed between the anode down-lead pole and the anode down-lead ring.

17. The field emission lamp as claimed in claim 1, further comprising an endpiece and a getter, the endpiece being associated with the bulb, the getter being formed on the endpiece.

18. The field emission lamp as claimed in claim 17, wherein the getter comprises a conductive film.

19. A field emission lamp comprising:

a lamp bulb securable to be gas-sealed and vacuumed therein;

an anode layer with a fluorescence layer thereon formed along an inner surface of said lamp bulb; and a cathode comprising a metallic base body with a plurality of electron emitters formed on an outer surface of said metallic base body, said cathode placed in said lamp bulb and spaced from said anode layer so as to emit electrons from said emitters toward said fluorescence layer for light emission of said lamp.

20. A field emission lamp comprising:

a lamp body securable to be vacuumed therein;

an electrifiable anode layer capable of emitting light for said lamp and formed along an inner surface of said body; and a cathode comprising a metallic base body with a plurality of electron emitters formed on an outer surface of said metallic base body, said cathode supportively placed in said lamp body by means of a column to be spaced from said anode layer and electrifiable to emit electrons from said emitters toward said anode layer for light emission of said lamp under electrification onto said anode layer and said cathode respectively.

* * * * *